United States Patent [19]

Napadow

[11] Patent Number: 4,567,818

[45] Date of Patent: Feb. 4, 1986

[54] CIRCULAR SPRAY BOOTH

[75] Inventor: Stanley C. Napadow, Elgin, Ill.

[73] Assignee: Protectaire Systems Co., Elgin, Ill.

[21] Appl. No.: 612,301

[22] Filed: May 21, 1984

Related U.S. Application Data

[63] Continuation-in-part of Ser. No. 486,700, Apr. 20, 1983, Pat. No. 4,484,513, which is a continuation of Ser. No. 232,124, Feb. 9, 1981, abandoned, which is a continuation-in-part of Ser. No. 129,484, Mar. 11, 1980, abandoned.

[51] Int. Cl.[4] ..... B05B 15/04

[52] U.S. Cl. ..... 98/115.2; 98/115.3; 118/326

[58] Field of Search ..... 98/115 SB, 115 LH, 115.2, 98/115.3; 118/326, DIG. 7, 634

[56] References Cited

U.S. PATENT DOCUMENTS

| | | | |
|---|---|---|---|
| 3,018,847 | 1/1962 | Stanly | 55/241 |
| 3,967,942 | 7/1976 | Pain et al. | 98/115 SB |
| 4,207,833 | 6/1980 | Napadow | 118/326 |
| 4,276,064 | 6/1981 | Gerdes | 98/115 SB |
| 4,295,866 | 10/1981 | Kearny | 98/115 SB |
| 4,354,451 | 10/1982 | Vohringer | 98/115 SB |

FOREIGN PATENT DOCUMENTS

| | | | |
|---|---|---|---|
| 35905 | 9/1981 | European Pat. Off. | 98/115.2 |
| 1192088 | 10/1959 | France . | |
| 710173 | 6/1954 | United Kingdom . | |
| 1589853 | 5/1981 | United Kingdom | 98/115.2 |

*Primary Examiner*—Henry C. Yuen
*Assistant Examiner*—John Kwon
*Attorney, Agent, or Firm*—Fitch, Even, Tabin & Flannery

[57] ABSTRACT

Spray particles are removed in at least a 180° surround of an article traversing an arcuate path in the interior of a spray booth. The booth includes a water wash extending vertically for a height greater than the work area and a spray area and preferably extends upwardly to the area of an overhead conveyor. Air flow is maintained at a substantially constant velocity to carry overspray particles into the water wash and away from the article and a water particle eliminator eliminates water particles from the cleaned air being discharged. The preferred booth comprises a plurality of adjacent units set at angles to each other to define a polygon of at least 180° with a planar water wash means being provided in each unit. A conveyor protection device may be used which discharges positively pressure air from a housing about the conveyor with the air flow in the booth pulling this blown air away from the spray areas and booth portal and into and through the water wash.

14 Claims, 4 Drawing Figures

10
26
42
42a
56
100
46
80
84
83
82
72a
72b
96
99
60
58
54
86
88
53
55
59
52
61
12
20a
76
98
78
90
92
36
94
79
40
85
74
34
83
64
66
38

50
10'
28
56
48
82'
153
20'
154
150
34'
165
36'
165
76'
92'
14
12
16
90'
160
61
98'
152
38'
74'
66'

CIRCULAR SPRAY BOOTH

This is a continuation-in-part of application Ser. No. 486,700 filed Apr. 20, 1983, now U.S. Pat. No. 4,484,513, which in turn is a continuation of application Ser. No. 232,124 filed Feb. 9, 1981, abandoned, which, in turn, is a continuation-in-part of application Ser. No. 129,484 filed Mar. 11, 1980, abandoned.

This invention relates to spray booths and more particularly to circular spray booths using water washes to remove particulates from the air flowing through such booths.

With present clean air standards and the increasing use of automated equipment for spraying and in particular paint spraying, there is a need for spray booths which can meet the exacting standards and function over relatively long periods of time with reduced maintenance and cost of operation.

In conventional rectangular spray booths, an applicator, such as a spray gun, directs atomized particles of paint or the like at a targeted article which is typically suspended from a moving conveyor. Apparatus for cleaning the air, such as dry filters or water spray apparatus, are disposed behind the targeted articles and collect overspray paint. When painting with spray gun applicators that generate forceful sprays, a large amount of sprayed paint overshoots the article. Furthermore, the forceful sprays may unevenly coat the passing article.

Recently, centrifugal atomizing apparatus has been developed which has replaced spray guns in many applications. In such apparatus, atomized paint is emitted from multiple openings in a spinning disc-shaped applicator. The centrifugal atomizing apparatus produces a fine mist of paint rather than a strong directed spray of paint, resulting in a more even coating and less wasted paint. However, because the spray is less directed, being broadly distributed to a surrounding area, efficient painting cannot be achieved in a conventional rectangular booth with the applicator, the targeted article and the air cleaning apparatus linearly aligned.

In order to best utilize centrifugal atomizing applicators, circular spray booths have been developed in which the target area comprises a major portion of the booths circumference. Articles are transported through such a booth by a circumferential conveyor to assure adequate coverage of the article by the mist of paint generated around the applicator. The articles and paint mist are electrostatically charged. To accommodate ingress and egress of the article, such booths have an entrance portal at one end, and means are provided to prevent the applicator from generating the mist in the region of the entrance portal. Typically centrifugal applicators are adapted so that the mist is generated in a region extending between about 210° and about 270° about the applicator.

Circular spray booths which have been heretofore developed having a substantially cylindrical chamber with a lower row of dry filters and having a blower means for drawing air through the booth and out through an exhaust vent. This lower row of dry filters is interposed in the air flow pathway to remove paint particles from the paint-laden air before the air is emitted through the exhaust vent. Dry filtering of paint particles has serious drawbacks. The filters rapidly become clogged with paint, hindering air flow, and the filters need to be replaced often e.g. every four hours, requiring down-time of the apparatus and substantial maintenance costs both in labor costs and replacement filter costs. Furthermore, the percentage removal of paint particles from the air using dry filters is frequently less than is desired, and it is difficult to maintain adequate exhaust air purity to meet with environmental standards.

The air flow through the dry filters drops very rapidly and substantially as the filters become loaded with trapped particles. At lower air flow rates, paint particles may settle onto the floors, booth walls or the conveyors. When the dry filters become so filled that the air flow therethrough is reduced substantially, the overspray particles are not withdrawn and may drop onto the articles and create an "orange peel" appearance on the product. Also, the floors of circular booths are generally covered in paint. The conveyor is located at the upper end of the booth with the articles carried on depending hangers. The filters are at the bottom of the booth, usually at floor level, to draw the overspray particles down from the conveyor area to prevent contamination of the conveyor. In one sense, these dry filters may be considered a variable air velocity booth in which the air velocity is initially high and then continues to drop as the filters fill with overspray particles. The low velocity air flow through substantially filled dry filters has been a factor in preventing the use of forcing air through the conveyor channel, such as disclosed in Napadow U.S. Pat. No. 3,749,229, to preclude overspray particles from entering into the conveyor channel and contaminating the conveyor. Often, the air flow from such a conveyor protection device is in the range of 1000 to 2000 cfm. When the air flow velocity in the conventional round booth is very low, the air discharge from the conveyor protection device could cause turbulence in the spray pattern and, in some instances, actually cause paint to be blown out of the booth portal and into the factory. Thus, there is a need for more efficient particle filtration and at a more constant velocity air flow for these circular spray booths.

A general object of the invention is to provide a circular or surrounding spray booth having efficient water wash means for removing paint particles from the air so that the coating advantages of centrifugal atomizing devices can be realized without sacrifice of either air quality or booth operating efficiency.

In accordance with the present invention, a circular or surrounding spray booth is provided having water washing means for cleaning overspray paint particles from air which has become laden with paint during its flow through the booth. Although the booth is considered to be "circular" because a centrifugal applicator generates a mist of paint particles around a generally circular coating region, in the preferred embodiments of the booth, the shape of the booth itself is more aptly described as polygonal, e.g., octagonal, including several sides defined by individual water-washing units. A centrifugal atomizer is disposed centrally within the booth so that its effective paint-spraying arc, e.g., between about 210° and about 270°, is enclosed by the water washing units. Conveying means transport articles to be sprayed through an open front portal of the booth, which is outside of the spraying arc of the atomizer, and along a circular path around the atomizer, whereby the articles are coated through an extended length of travel through a generally uniform paint particle mist. The air cleaning units each include water washing means in the form of a water curtain and/or a water spray and preferably both so as to remove substantially all paint particles from the air that flows therethrough and substantially increase the efficiency of overspray removal over a wide range of paints including fine grain paints that pass more readily through dry filters. Air flow means associated with the air cleaning units pulls air at a substantially constant velocity over long periods of time and over a large vertical heights across the paint spraying region and then through the water-washing means and directs the cleansed air outward through an exhaust vent.

These and other objects and advantages of the invention will become apparent from the following detailed description taken in conjunction with the accompanying drawings in which.

Figure 1:
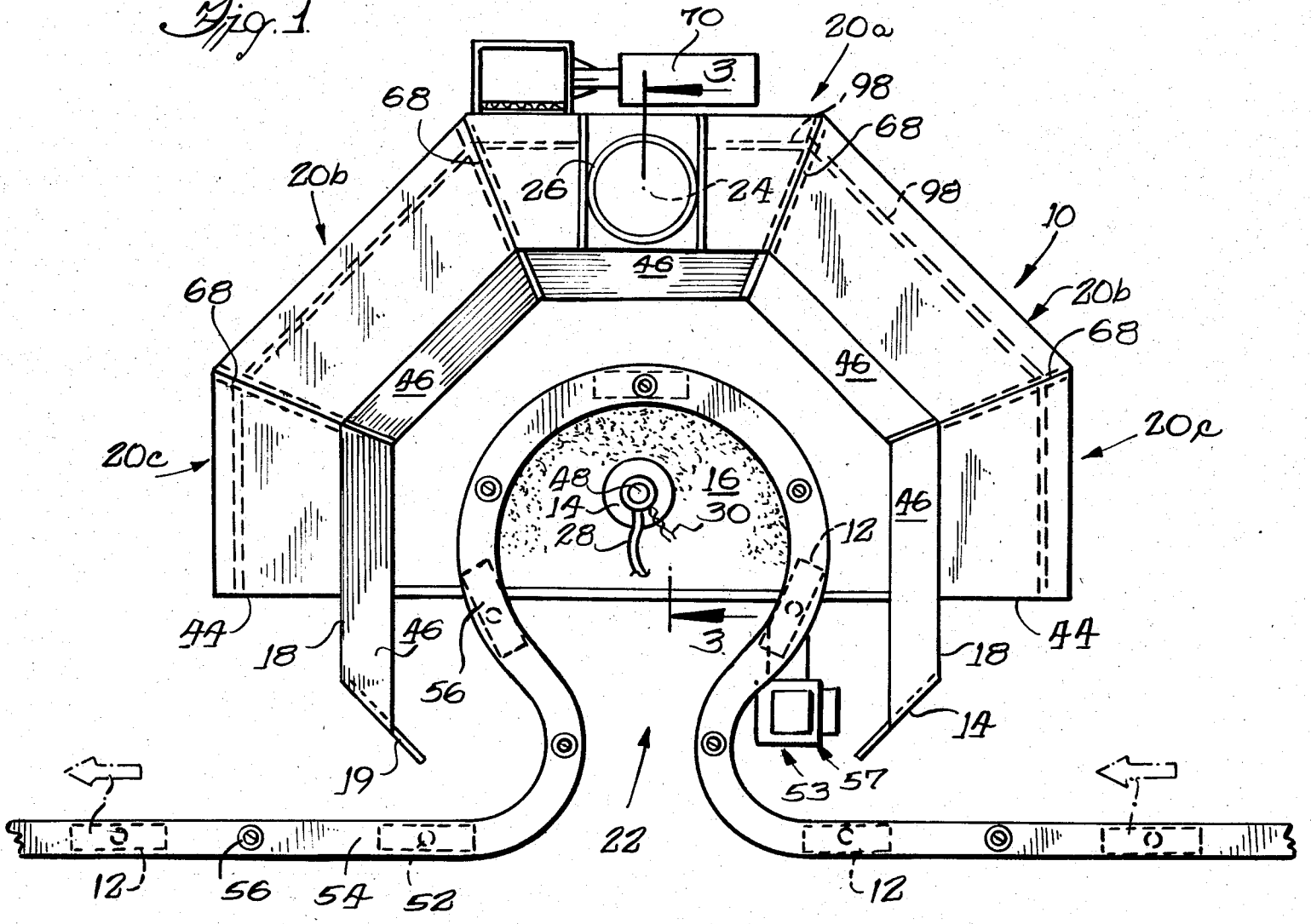
FIG. 1 is a plan view of a paint spray booth embodying various features of the present invention.

As shown in the drawings for purposes of illustration, the invention is embodied in a circular spray booth 10 in which articles 12 are conveyed in a generally circular path around a centrifugal atomizing paint applicator 14 which produces a generally uniform mist of paint particles in a wide arcuate region 16 therearound. The paint spraying region 16 is confined within a substantially enclosed region bounded by an air cleaning housing or means including inlet and outlet wall segments 18, 19. The front of the booth is an open portal 22 that permits ingress and egress of the articles 12 that are to be painted. An air flow through the booth is created by air flow or blower means (represented at 24 in FIG. 1) associated with an exhaust vent 26, the blower drawing air through the front portal 22 of the booth, and through the booth before exhausting the cleansed air through the vent 26.

Figure 2:
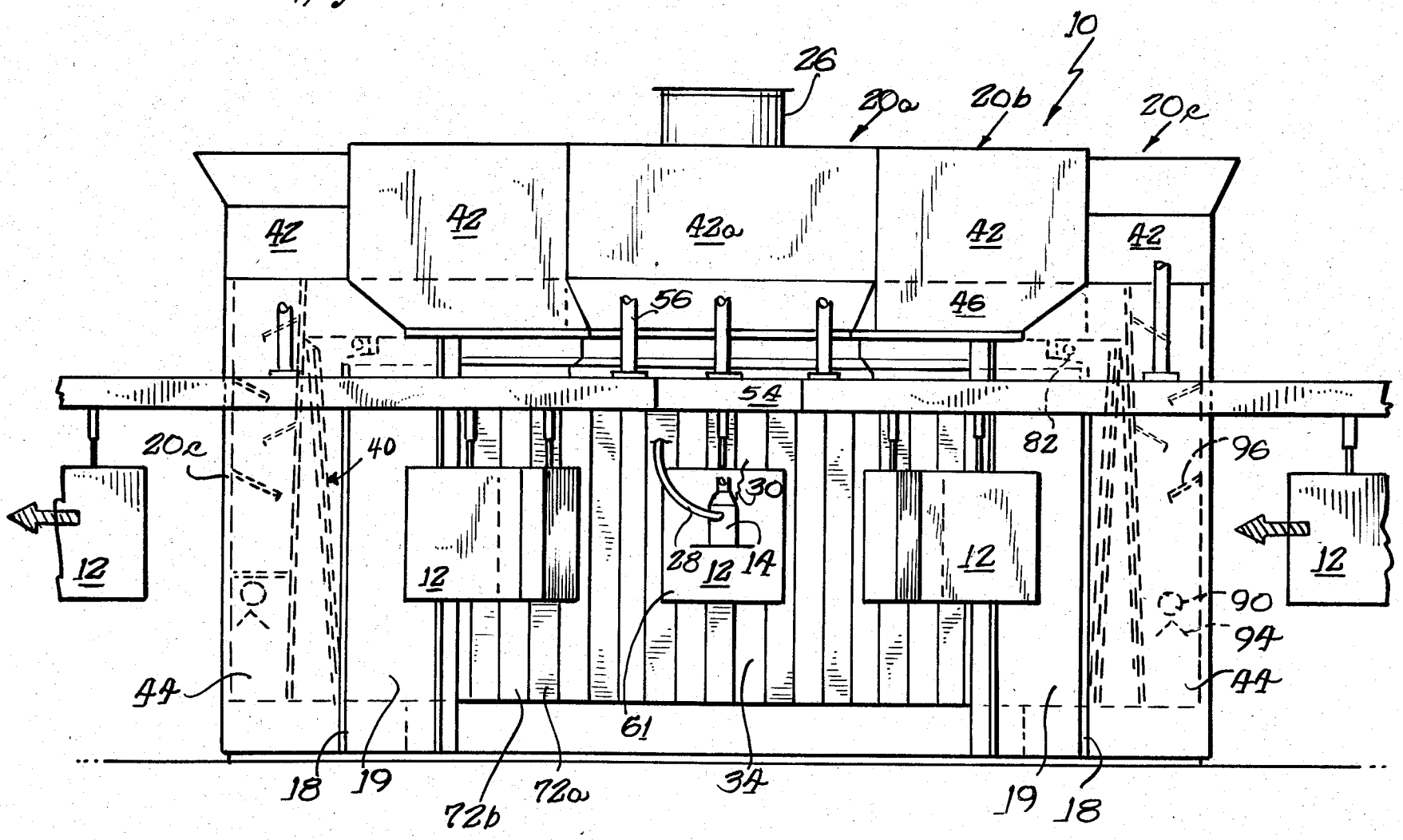
FIG. 2 is a front elevation view of the paint spray booth of FIG. 1.

The atomizer 14, shown in FIG. 2, is a centrifugal disc-shaped atomizer which is supplied through a flexible conduit 28 with paint or other coating material and atomizes the same into a fine spray or mist. Means (not shown) which comprise no part of this invention limit the distribution of spray from the atomizer to the major arcuate misting region 16 that is less than a full circle, the arcuate misting region typically being about 210° to about 270°, so as not to direct paint spray through the front portal 22. In preferred coating applications, the centrifugal atomizer 14 has electrical means 30 for electrostatically charging the paint particles and means (not shown) are provided for oppositely charging the conveyed articles 12 to promote collection of the paint particles on the articles; however, the invention applies to both electrostatic and non-electrostatic paint spraying. Centrifugal atomizers are commercially available, for example from Ransburg Electrostatic Equipment Co. of Indianapolis, Ind. and Graco Incorporated of Minneapolis, Ind.

In the conventional dry filter booth, having a height of about nine feet, a bank of filters of about 20 inches in height are located at the floor level and connected to common plenum and duct which leads to an exhaust blower and a stack. The remaining upper seven feet of the booth is comprised of a partially cylindrical wall of sheet metal. In such a typical booth, the overhead conveyor would be located about seven feet above the floor level so that about five feet or more of space exists between the conveyor and the air filters and air exhaust plenum. The concept is to draw down the air from the conveyor area to prevent contamination of the conveyor without disturbing the paint air mist area 16 as would interfere with the coating of the articles. Because all of the air goes through a twenty inch high band of filters at the lower end of the booth, the filters tend to fill quite quickly, e.g. in about four hours in heavy duty spray operations. The air flow velocity drops substantially as the filters fill and this may result in overspray dropping onto the articles and creating an "orange peel" appearance to the coating. Further, the removal efficiency for fine grain paints may be as low as 75% for a circular booth. Because of the fear of low air flow through the booth, air filled conveyor protection devices are not used with the conventional booth. The downtime to change filters and the costs of new filters are very substantial expense factors in these conventional circular spray booths.

Figure 3:
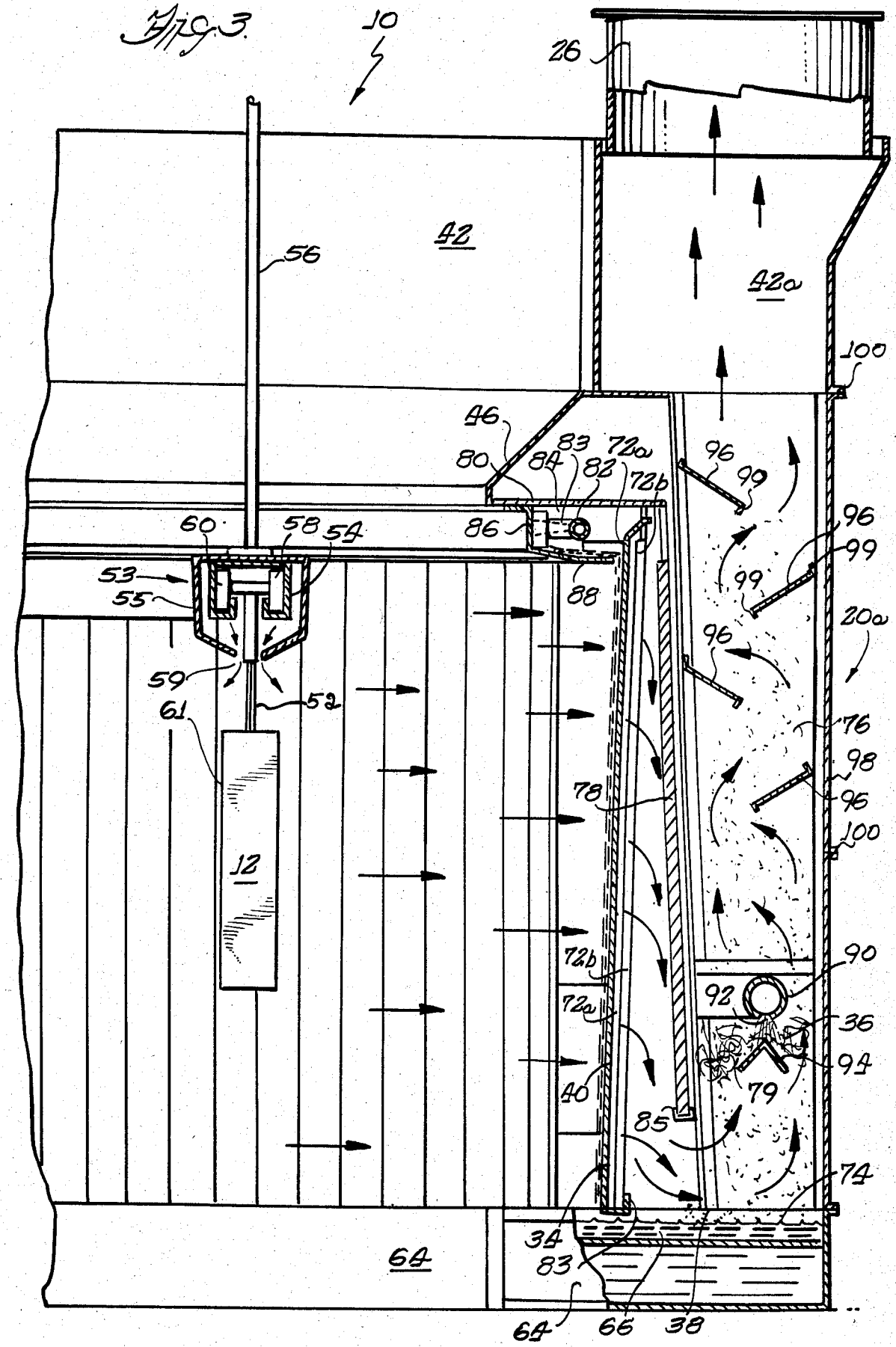
FIG. 3 is a cross-sectional view taken along line 3—3 of FIG. 1.

In accordance with the present invention, most or all of these problems are eliminated by having water wash or air cleaner units 20*a,b,c* arranged in a generally surrounding arc of greater than 180° and preferably of about 210° to 270° and pulling air therethrough at substantially constant velocity. The preferred water wash units have water wash panels that extend vertically for the full height of the article being painted, rather than being located at the floor level at an area below the work, and provide a greater surface area across which the air flows than in the dry filter booth. The preferred water wash units, such as shown in FIG. 3, provide a substantially uniform horizontal flow of air and a substantially constant velocity of air flow across the work piece and the conveyor over a large vertical height at each unit so as not to disturb the paint mist area 16 as would interfere with the painting. A known sludge remover apparatus can be attached to the water reservoir to remove accumulated paint scum from the water, allowing the booths to be used for weeks or months before being down for maintenance. Also, an air protection device as shown in the aforementioned patent may be used to force air through the overhead conveyor to protect the conveyor. While the water wash units 20 have many more components than the dry filter booth and may cost substantially more initially, the economies realized in less maintenance, less faulty part coverage, less downtime, and no filter costs quickly overcome this initial price differential.

More specifically, and as illustrated, the present invention comprises the plurality of units 20*a,b,c* each having a planar water wash panel extending vertically and with the units at angles to each and equally spaced from a central axis of the booth at which the spray device 12 is located. Each unit 20 is spaced at an equal distance from this axis and herein the units define a portion of a polygon, such as five sides of an octagon. The air is drawn sideways from the center of the booth toward each of the water wash panels and across the workpiece which is located in front of one of the units. More specifically, the booth comprises air cleaning units 20 which surround the arcuate paint spraying region 16 have water washing means 34, 36, and 38 which more thoroughly clean the air and require less maintenance than the dry filter air cleaning systems that were heretofore used in circular paint spraying booths. In preferred embodiments of the invention, paint-laden air is drawn into a forward air cleaning region 40 (FIG. 2) of each unit 20 where it passes first through a broken curtain 34 of cascading water and then through a rearward second water wash 36 that is created behind the curtain. The water curtain 34 removes the major portion of larger paint particles drawn into the unit 20, while the turbulent spray in the second water wash 36 removes substantially all of the paint particles that escape the cascading water of the curtain. After being contacted with water, the air is drawn into an upper plenum region 42 having an expanded cross-sectional area that acts to slow the flow of air therethrough so that paint particle-carrying droplets of water tend to precipitate from the flowing air. The air which exits the vent is substantially free of paint particles usually at an efficiency of 98% or greater and easily meets environmental standards. The air flow is at a substantially constant velocity in contrast to the variable air velocity flow of the dry filter round booths so that there is less likelihood of overspray dropping onto articles, the booth, or the floor.

The illustrated booth 10, as best seen in FIG. 1, has an incompleted octagonal configuration with five air cleaning units, 20*a,b,c* forming approximately two thirds of an octagon. The atomizer 14 is positioned within this octagon behind the forward sidewalls 44 of opposed lateral units 20*c* so that the major arcuate region 16 that is surrounded by the air-cleaning units 20*a,b,c* is about 210° or more and approximates the misting of the atomizer. Extending straight forward of the pair of opposed lateral units 20*c* is a pair of opposed lateral wall segments 18, and angling toward each other are a pair of wall segments 19 that complete two additional sides of the octagon, seven sides of which are enclosed. The final side of the octagon is the open front portal 22 through which the articles 12 enter and exit the booth.

A polygonal shape, e.g., octagonal, for the booth 10 is preferred to a truely circular shape because it eliminates the additional expense involved in manufacturing curved parts. Each of the individual units 20*a,b,c* is constructed of flat sheets of metal which can be bolted together in the conventional manner. By providing the air cleaning means in a plurality of individual units rather than as a single unit, problems in maintaining uniform cleaning conditions over a large area are avoided.

An overhanging lip 46 is provided extending inward of the units 20 on five sides; however, the top of the booth is substantially open, resulting in air being drawn into the booth both through the front portal 22 and through the top. Although the top of the booth could be covered, the downward flow of air through the open top of the booth helps to convey paint particles away from the conveyor mechanisms, thereby promoting reliability of the same.

The centrifugal atomizer 14 is disposed centrally with respect to the lateral units 20*c* and generally centrally relative to the portal 22 and to the front of the central rear unit 20*a*, but rearward of the forward sidewalls 44 of the lateral cleaning units 20*c*. The atomizer 14 is mounted at the end of a rod 48 (illustrated in the alternative embodiment shown in FIG. 4), which, in turn, is mounted from above by means 50, such as a pneumatic cylinder, for reciprocation up and down so that the mist of paint generated by the atomizer is everly distributed over a broad vertical region and thereby tends to evenly coat an article 12 having a large vertical dimension. To accommodate the vertical reciprocation of the atomizer 14 and rod 48, the conduit 28 through which paint is supplied to the atomizer is a flexible tube.

In the illustrated conveyor system, articles 12 are suspended from hangars 52 (FIG. 3) which are driven along an overhead track 54 which is suspended by rods 56 from the ceiling (not shown) of the plant. The illustrated conveyor path (FIG. 1) is straight on either side of the booth 10 but follows a nearly complete loop 56 through the booth. Along this route, the articles 12 are sprayed for a substantial distance within the paint-misted region 16. Because the air flow being drawn through the water washes and across the articles 12 is a substantially constant velocity and is maintained at a high velocity flow, it is possible to use an air protection device 53 (FIGS. 1 and 3) with the conveyor channel track 54 to blow air through a protective housing 55 about the track 54. The air is blown into the housing by a motor driven blower 57 (FIG. 1) for flowing longitudinally through the housing and discharging downwardly at the gap 59 through which depends the hanger 52 carrying the article 12. This expelled air prevents upward flow of overspray into the conveyor. Because of the high and constant velocity of air flow through the water wash units at the height of the air discharge from the gap 59, the expelled air is quickly drawn laterally away from the paint spray and articles to prevent any turbulence as would adversely effect the quality of the paint coating on the article 12. The protection device 53 may be of the type shown diagrammatically herein or of other types made by the assignee of this invention.

The illustrated hangars 52 have overhead wheels 58 that travel along depending track brackets 60 of the conveyor mechanism. The illustrated hangars 52 do not rotate and thus expose a single side 61 of each article to the atomizer. To coat other sides of the articles, the conveyor carries the articles through additional booths with other sides exposed to atomizers. If complete coating of an article is desired within a single booth, rotating hangars are known in the art for turning the article as it passes through the coating region.

Because each article 12 is conveyed for a substantial distance through the booth 10 and is exposed to the mist of paint for along an extended travel path, the spray need not be as intense as the spray emitted from guns which conventionally direct spray at a passing article. Substantial travel of the article through a mist of paint tends to promote even coating, especially with electrostatic apparatus. Further, with electrostatic spraying, a less intensely directed mist gives the charged particles more time to be attracted to the oppositely charged article, resulting in less waste of paint and an easier task in maintaining the quality of the air.

The individual units 20*a,b,c* each provide an air-cleaning area extending above and below the vertical region 16 misted by the atomizer and a generally uniform horizontal flow of air to prevent upward travel of paint particles into the conveyor. The lower tank 64 contains a reservoir 66 of water and extends between and across the units to provide a common water reservoir. The air cleaning are of each unit 20 is joined to the air cleaning area of an adjacent unit so that the air may flow to a common outlet duct 26. The upper plenum regions 42 thus are also interconnected so that each unit 20 need not be associated with an individual blower 24 and exhaust vent 26. In the illustrated booth 10, a single blower 24 and vent 26 associated with the rear unit plenum 20*a* are relied upon to create the air flow through the booth; however, in some booths two blowers and vents are used, e.g., in the two units 20*b* flanking the rear unit 20*a*. The reservoirs 66 of each unit 20*a,b,c* are also preferably interconnected so that a single pumping means 70 (FIG. 1) can be used to recirculate the water for the entire system.

In the most preferred embodiment of the invention, primary air cleaning is effected by a curtain of water cascading down staggered, substantially vertical baffles 72*a*, 72*b* (FIG. 3). A front row of spaced-apart baffles 72*a* and a laterally overlapping rear row of spaced-apart baffles 72*b* provide water coated surfaces down which water flows. Thus, there is provided a curtain 34 of water which extends from the top substantially to the bottom of the air-washing area so as to interdict substantially the entire air-flow pathway while allowing good airflow therethrough between adjacent panel edges. As the paint particles impinge upon the water curtain 34, they collect on the water and are carried downward into the reservoir 66. As the air must flow between the baffles rather than through a free-falling water curtain below a water curtain-forming means, as is common in many water wash systems, there is relatively little escape of paint particles, such as may be the result of the air flow blowing aside a free-falling water curtain.

Although the baffles 72 that comprise the staggered rows are intended to inderdict substantially the entire air flow pathway, it is preferred that their lower ends be spaced slightly above the surface of the water in the lower reservoir 66 to avoid accumulation of paint on the baffles due to floating paint particles on the water surface 74 hitting the baffles. In operation, the water falling from the baffles and the air cause the water to splash about the baffle ends so that the air passing beneath the lower ends is also washed.

A partition 78 behind the staggered rows of baffles define a rear air-cleaning region 76 of the booth where the spray or mist of water 36 is used to catch any paint particles that may have escaped the water curtain 34.

The water wash baffles 72 *a,b* are either vertical or inclined slightly forward from top to bottom while the partition 78 is inclined rearward from top to bottom, creating a region of increasing cross section behind the water wash baffles. The increasing cross-sectional area behind the primary water wash baffles 72 accommodates the increasing amount of air flowing in the downward direction between the baffles and partition 78 and does not block a uniform flow of air across the lower ends of the baffles as would be the case if the air-deflecting partition were vertical and provided a uniform cross-sectional space behind the baffles. For instance, and by way of example, if 500 cfm of air flow across the upper one foot of the baffles 72, and a second 500 cfm of air flows across the next lower one foot of the baffles, the space behind the second foot must be larger to accommodate the now 1000 cfm appearing in such space. The incline of the partition 78 provides such additional space so that the air from above and flowing down in this space between the baffles and the partition does not substantially impede the air flow across the lower portions of the baffles 72. Thus, substantial, uniform air flow is maintained across the baffles 72 and through the space behind the baffles.

The downwardly directed air passes over and contacts the water surface 74 which accumulates in the lower reservoir 66 at the bottom of the booth 10. The air flowing down between baffles 72 and the partition 78 turns and flows through the third water wash 38 in which water falls from the rearward side 79 of the lower edge of the partition 78. Furthermore, if paint particles contact the surface 74 of the water in the reservoir 66, some additional air cleaning may take place.

The water to create the curtains 34, 38 flowing down the staggered rows of baffles 72 and down the rear side 79 of the partition 78 is pumped through an inlet manifold 82 which extends through an upper region 84 along the upper end of the forward air cleaning region. This upper region 84 is defined by the horizontal panel 80 disposed below the overhanging lip 46 and from which the staggered baffles 72 and the partition 78 are suspended, a front panel 86 and a slightly inclined but generally vertical lower panel 88. Nozzles 83 of the manifold 82 are directed against the front panel 86 so that sprays of water strike thereagainst and either splash rearward or flow downward along the inclined lower panel 88 to the upper ends of the baffles 72 and of the partition 78.

In the rear air-cleaning region 76 of each unit and 20, the sprays 36 of water are produced by a manifold 90 having nozzles 92 spaced at intervals across the width of the unit. The nozzles of the illustrated manifold are directed downward against the peak of splash plate 94 that has the form of an inverted "V". The splashing water droplets are deflected outwardly and upwardly and are turbulently mixed with the upwardly flowing air, creating a turbulent water wash 36 throughout the rear air-cleaning region 76.

As the partition 78 which separates the front rear cleaning regions 40, 76 is suspended at an incline relative to the vertical rear wall 98 of the unit 20, the cross-sectional area of the rear air-cleaning region 76 expands upward, resulting in the air flow upward through the rear cleaning region decreasing in velocity from the bottom toward the top of this region. Thus, whereas the splashed water tends to become entrained in the faster flowing air toward the bottom of the rear air-cleaning region 76, the water droplets tend to precipitate out of the slower moving air toward the top of the region. Furthermore, air-flow baffles 96 intrude into the rear air-cleaning region from the rear wall 98 and from the partition, creating an air-flow pathway of continually changing directions which facilitates the paint-particle-carrying water droplets to collide with the deflectors 96 and to be removed from the air. The air-flow baffles 96 also provide surfaces along which water can collect. The baffles 96 are inclined downward from adjacent to the rear wall 98 and from the partition 78 so as to more readily shed water. The baffles 96 extend the width of the unit 20 in order to balance and to maintain relatively uniform air-flow characteristics across the width of the unit. The air-flow baffles 96 are suspended across the length of the unit 20 a substantial lateral distance, and to stiffen the air-flow baffles, which are supported between the sidewalls of the units and unsupported interior thereof, the baffles are formed with right angle-edge flanges 99. The edge flanges at the lower ends of the baffles are downturned to prevent accumulation of water thereat.

The plenum region 42 above the rear air-cleaning region 76 is further increased in cross-sectional area relative to the rear air cleaning region, typically having about twice the cross-sectional area as the rear air-cleaning region at the lower end of the partition 78. Air flow slows substantially in the plenum region 42, and any entrained water droplets tend to precipitate from the air in the plenum region.

Water within the booth 10 is continually recirculated. Water is withdrawn from the lower reservoir 66 by the pump means 70, and pumped to the inlet manifold 82 that provides water for the curtains 32, 38 and also to the spray manifold 90. While a filter means may be provided to protect paint particles from clogging the pump means 70, withdrawal of the water generally at the bottom of the lower reservoir 66 helps to keep the pump means 70 free of the paint particles, which tend to float on the surface of the lower reservoir.

As the booth 10 is intended to retain substantially all spray paint, the booth quickly accumulates sizeable amounts of paint material. The booth 10 is constructed so as to facilitate cleaning and maintenance. While the paint accumulates primarily in the lower reservoir 66, paint also accumulates elsewhere in the unit 20. To provide access for cleaning and/or maintenance, the rear wall 98 of each unit 20 is constructed of a plurality of panel sections having flanges 100 which extend outwardly in planes perpendicular to their respective panel sections. Fastening means, such as bolts, connect the flanges 100 of adjacent panel sections. Access to each unit 20 may be obtained by unbolting and removing a panel section.

The bulk of paint particles washed from the air accumulate in the lower reservoir 66 and must be periodically removed. Preferably, known types of sludge removal apparatus are used to remove sludge from the water without having to shut down the booth.

The baffles are joined together in a unit which may be lifted from the booth 10. At the bottom, the baffles 72 rest in a U-shaped channel 83 which extends generally across the width of the booth 10. At the top, the baffles are removably hooked to the horizonal panel 80. The partition 78 is easily removable from the booth. Its lower end merely rests in an angle 85 extending between side panels 44, 68 and its upper edge is fastened to the horizontal panel 80 of the booth.

By way of specific example a paint spraying booth 10 is constructed substantially as shown and described with reference to FIGS. 1–3. The booth 10 includes about five sides of an octagon with the interior region 16 between opposed wall segments 18 and 19 and/or water curtain-forming baffles 72 is about 12 feet. The rear unit **20*a* and the flanking units 20*b* each presents a water curtain face about 6½ feet wide across while the lateral units 20*c* present a water curtain face about 5 feet across. The depth of the air cleaning units 20 between their water curtain forming baffles 72 and their rear walls 98 is about two feet while the tanks 64, which contain the water reservoirs 66, and the overhanging lips 46 each extend inward approximately an additional foot. The tanks 64 extend to a height of about one foot off the ground, and the water curtain-forming baffles 72 extend about 6½ feet upward therefrom. The rear air cleaning region 76 begins at the lower end of the partition 78, suspended about 1 foot from the top of the tank 64 and extends upward to a height of about 8 feet above the tank. From the upper end of the cleaning portion of the booth, the plenum region 42** extends to an additional height of about 3 feet.

A single blower 24 associated with an exhaust vent 26 from the rear unit plenum **42*a* generates an air flow through the vent. The usual air flow velocity in the region of the atomizer 14** is between 60 fpm to 100 fpm depending upon the articles, the paint being sprayed, etc. and is preferably maintained at a constant velocity within this range.

Typical circular booths of the type herein disclosed have a range in diameters of 4 feet, 6 feet, 8 feet and 10 feet.

In this air cleaning booth 10, approximately 98 plus percent of overspray paint particles are removed. This compares favorably with dry filter booths where about a 74–78 percent paint particle removal is about typical for fine grain paints.

Figure 4:
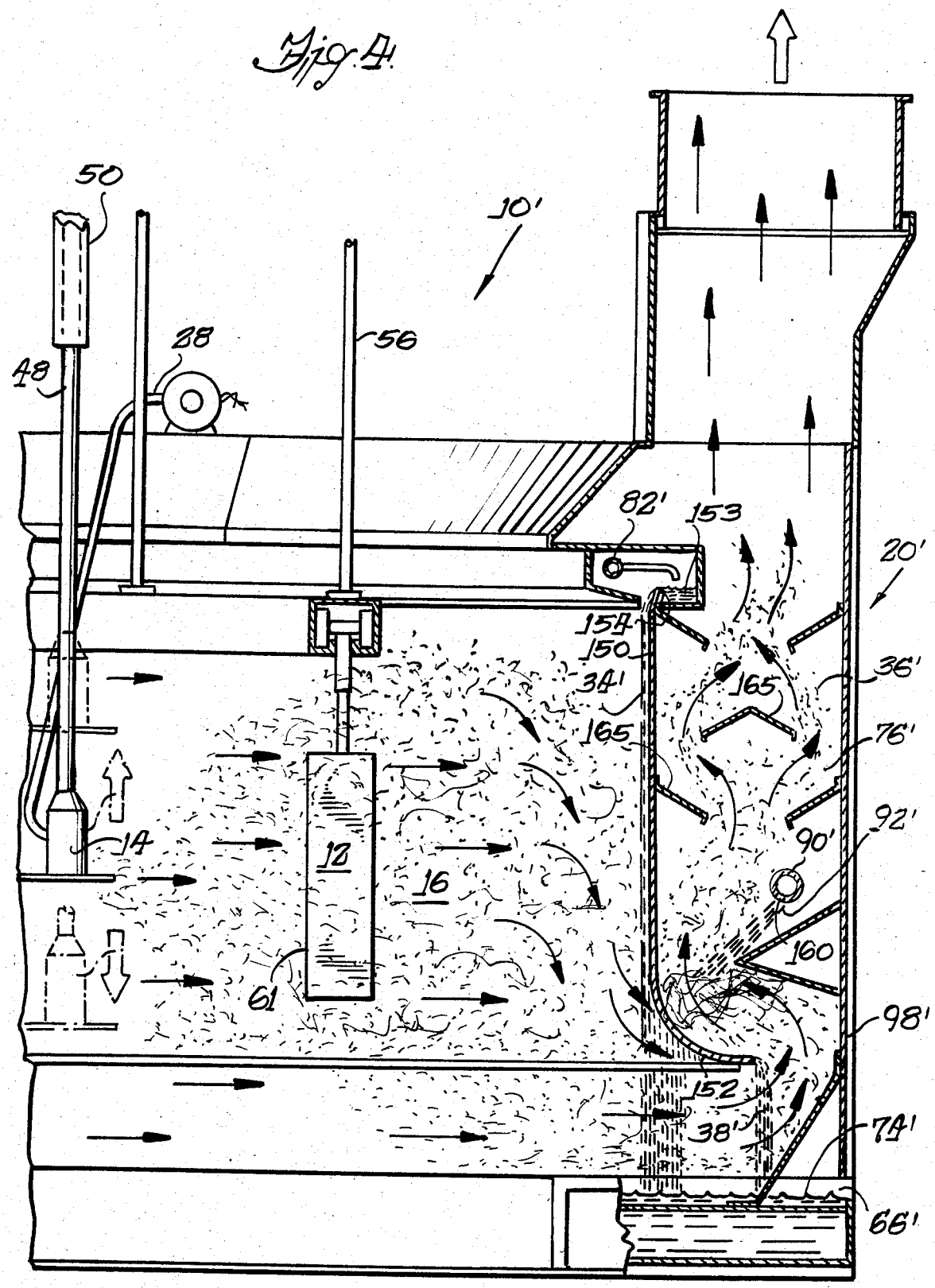
FIG. 4 is a cross-sectional view, similar to FIG. 3, of an alternative embodiment of a booth of the present invention.

Illustrated in FIG. 4 is an alternative embodiment Of a booth 10' of the present invention which is substantially similar to the booth 10 of FIG. 3 except that the water cleaning units 20' are of a more conventional type. In this booth 10' a solid curtain 34' of water cascades down a solid sheet 150 of material having its lower end spaced above the upper surface 74' of the reservoir 66', and all of the paint-laden air passed through the free-falling cascade 38' of water that drops from the lower end of the sheet 150. The lower end 152 of the sheet 150 is rounded in a rearward direction, causing water to cascade along a deeper (in a front to rear direction) region than if the sheet were flat. The curvature of the sheet 150 also collects water from the rear air-cleaning region 76 on its rear curved surface, enchancing the intensity of the cascade of water that falls therefrom. The curtain 34' of water flowing along the front surface of the sheet 150 is provided by water supplied from an upper reservoir 153 that overflows a weir 154. The reservoir 153 is continuously resupplied through an upper inlet manifold 82'.

Water to create the second water wash 36' in the rear air-cleaning region 76' is also supplied through a manifold 90'. Nozzles 92' are directed at a splash plate 160 extending inward from adjacent to the rear wall 98' of the unit 20' to deflect the water to mix with air to form a turbulent water wash, 36'. These water droplets in the second water wash collect paint particles which may have escaped the curtain 34', 38' of water. Again, an arrangement of baffles 165 causes the air to flow through a lengthy tortious path that creates turbulence and increases contact between the entrained water droplets and entrained paint particles. The plenum region 42' is substantially enlarged relative to the most constricted regions of the rear air-cleaning region 76'.

The advantages of the invention can now be more fully appreciated. The invention eliminates the costly maintenance and downtime associated with so called "circular spray booths" which utilize centrifugal atomizers for painting uniformity and efficiency. The water wash may be effected over a height including the workpiece and the conveyor to draw air horizontaly and uniformly across the work piece through about 210°. The conveyor is protected. The paints particles are caught with high efficiency for over long periods without filter replacements.

While the invention has been described in terms of certain preferred embodiments, modifications obvious to one with ordinary skill in the art may be made without departing from the scope of the present invention.

Various features of the invention are set forth in the following claims.

What is claimed is:

1. In a spray booth for surrounding about 210° to 270° or more of travel of article in a curved path in the booth, the combination of comprising:

a centrifugal atomizer for coating material in a spray area of over an arc of at least about 210° to 270° or greater and over a predetermined vertical distance for a workpiece, a booth having walls defining a surrounded region of at least 210° to 270° or greater extending vertically above and below the spray area, said booth comprising a plurality of water wash units about the spray area and leaving an open front portal, said booth comprising lateral side water wash units on each side and a rear water wash unit opposite the front portal, a first water wash means in the water wash booth units extending vertically above and below the spray area and surrounding at least 210° to 270° or greater of the spray area to collect overspray particles, second water wash means in the water wash units including a turbulent spray of water and air for washing overspray particles from the air, eliminator means for eliminating water particles of coating material from the air before discharge, and a common water tank means for holding water for said water wash means and extending across a lower portion of the booth and beneath the article to be sprayed for collecting coating material dropping toward a floor beneath the water tank means, exhaust means for pulling air sideways from the spray area for at least 210° to 270° or greater of the booth through the first wash means and then through the second water wash means and the eliminator means for discharge of cleaned air from the booth, said exhaust means pulling the air rearwardly and laterally at a substantially constant velocity through the first and second water wash means.

2. A spray booth in accordance with claim 1 in which said first water wash means comprises:

panels of staggered baffles having air flow passages therebetween, the panels being generally planar and set at angles to one another to define a surrounding region of greater than 180°, the panels each being equally spaced from a central axis for the booth, at which axis is located the centrifugal atomizer.

3. A spray booth in accordance with claim 2 in which means cooperate with the panels of staggered baffles to pull the air substantially horizontally and at substantially uniform velocity across the workpiece and conveyor and through the staggered baffles throughout the height of the spray mist area.

4. A spray booth in accordance with claim 1 in which the first water wash means comprises substantially vertical panels each disposed at angles to each other to define a surrounding region of 180° or greater with water flowing down each of the panels to interdict overspray particles.

5. A spray booth in accordance with claim 1 in which a plurality of spray units having planar first water wash units are disposed side-by-side to define a surrounding region of greater than 180°.

6. In a spray booth, the combination comprising:

centrifugal atomizer for distributing a spray of coating material over a major arcuate area of between about 210° and 270° or greater, the booth having a substantially U-shaped configuration and having substantially vertical water wash panels with water flowing down the panels to trap air borne particles of coating material, said booth substantially encircling said major arcuate area and said vertical water wash panels providing an air cleaning facility substantially surrounding said major arcuate area and leaving portal outside of and opening into said major arcuate area, an air exhaust vent and air flow means associated with said exhaust vent for drawing air through said portal through said air cleaning to said exhaust vent, said air cleaning facility having water wash means including said vertical water wash panels with water thereon for contacting said flow of air with water to collect coating particles from the air, means to convey articles to be coated through said major arcuate area including a U-shaped track means entering through said open portal and looping about said major arcuate area and returning to leave through said portal, and water tank means for receiving water from said water wash panels and for providing water for flowing down said panels.

7. A combination in accordance with claim 6 having means to reciprocate said atomizer vertically to more evently distribute the mist created thereby over a broader vertical area.

8. A combination in accordance with claim 6 wherein said water wash means comprises means forming a turbulent spray of water through which said air flows.

9. A combination in accordance with claim 6 wherein a first water wash means comprises a cascade of flowing water interdicting the flow of air and a second water wash means comprises means forming a spray of water through which said air flows.

10. A combination in accordance with claim 6 wherein sa water wash means includes a lower water reservoir, an upper manifold, pump means for recirculating water from said lower reservoir to said upper manifold, a first layer of baffles extending from adjacent to said upper manifold to closely adjacent to said lower reservoir, and a second layer of laterally baffles extending from adjacent to said upper reservoir to closely adjacent to said lower reservoir, said first and second layers of baffles conducting water from said manifold to said reservoir in a broken cascade of water that permits air flow therethrough yet presents a combined face that substantially completely interdicts the path of the air flow thereagainst.

11. A combination according to claim 6 wherein said water wash means includes a vertical region, means creating a mist of water within said vertical region for contacting air flowing upward through said vertical region, said vertical region expanding in cross-sectional area from the bottom upward, whereby a faster flow of air toward the bottom promotes entrainment of water and a slower flow of air toward the top promotes precipitation of water from the flowing air.

12. A combination according to claim 11 wherein said vertical region has baffles to promote air-water contact and to help remove water from the flowing air.

13. In a spray booth for surrounding about 210° or more of travel of article in a curved path in the booth, the combination comprising:

a centrifugal atomizer for generating a spray of coating material in a spray area of over an arc of at least 210° and over a predetermined vertical distance for a workpiece, a booth having a plurality of water wash units defining a surrounded region of at least 210° and extending vertically above and below the spray area, and leaving an open portal into the surrounded region, water wash means in the spray booth extending vertically above and below the spray area and surrounding at least 210° of the spray area and to collect overspray particles, a conveyor moving through the portal and about a curved path in the booth for carrying articles through the spray area, a conveyor protection device having a curved shape located upwardly adjacent the top portion of the booth for blowing air from a housing about the conveyor to prevent overspray from reaching the conveyor and for blowing air into the booth, exhaust means for pulling air sideways relative to the portal at a substantially constant velocity and for a least 210° of the booth to carry overspray particles and air blown from the conveyor protection device into and through the water wash means for discharge as cleaned air from the booth, and a top opening defined by the upper ends of the water wash units located above the conveyor protection device to allow air flow down therepast and into the spray area and then to flow sideways and rearwardly.

14. In a spray booth for surrounding about 210° or more of travel of article in a U-shaped path in the booth, the combination comprising:

a centrifugal atomizer of coating material in a spray area of over an arc of at least 210° and over a predetermined vertical distance for a workpiece, a booth having a plurality of water wash units defining a surrounded region of at least 210° extending vertically above and below the spray area and about the spray area and leaving a portal opening into the surrounded region, a portal opening into the surrounded region, water wash means in the water wash units and surrounding at least 180° of the spray area to collect overspray particles, some of said water wash units being generally trapezoidal in shape and having a front open side and a rear side, the front side being substantially smaller in width than the rear side, and inclined sidewalls extending between the front side and the rear side, conveyor means including a portion extending through the portal opening and a loop portion looping about the surrounded region and an outlet portion extending through the portal opening, said conveyor means conveying articles through the portal opening and about the loop portion about the spray area for exiting the booth at the portal opening, eliminator means for eliminating water particles from the air before discharge, and exhaust means for pulling air through the booth and through the water wash means and the eliminator means for discharge of cleaned air from the booth.

* * * * *

UNITED STATES PATENT AND TRADEMARK OFFICE

CERTIFICATE OF CORRECTION

PATENT NO. : 4,567,818

DATED : February 4, 1986

INVENTOR(S) : Stanley C. Napadow

It is certified that error appears in the above-identified patent and that said Letters Patent is hereby corrected as shown below:

Column 3, line 61 change "Ind." to --Minnesota--.
Column 6, line 5 change "hangars" to --hangers--.
Column 6, line 32 change "hangars" to --hangers--.
Column 6, line 34 change "hangars" to --hangers--.
Column 6, line 40 change "hangars" to --hangers--.
Column 6, line 61 change "are" to --area--.
Column 10, line 26 change "enchancing" to --enhancing--.
Column 10, line 52 change "horizontaly" to --horizontally--.
Column 10, line 66 after "combination" delete --of--.
Column 10, line 11 change "Of" to --of--.
Column 11, line 66 change "air borne" to --airborne--.
Column 12, line 32 change "sa" to --said--.
Column 13, line 17 second instance, change "a" to --at--.
Column 14, lines 8-9 after "region," delete "a portal opening into the surrounded region,".

Signed and Sealed this

*Twenty-sixth* Day of *August 1986*

[SEAL]

*Attest:*

DONALD J. QUIGG

*Attesting Officer*

*Commissioner of Patents and Trademarks*